US011305545B2

(12) United States Patent
Blanco Gabella

(10) Patent No.: US 11,305,545 B2
(45) Date of Patent: Apr. 19, 2022

(54) RENDERING FLUID DELIVERY

(71) Applicant: HEWLETT-PACKARD DEVELOPMENT COMPANY, L.P., Spring, TX (US)

(72) Inventor: Jaime Abel Blanco Gabella, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/768,854

(22) PCT Filed: Dec. 18, 2017

(86) PCT No.: PCT/US2017/067066

§ 371 (c)(1),
(2) Date: Jun. 1, 2020

(87) PCT Pub. No.: WO2019/125376

PCT Pub. Date: Jun. 27, 2019

(65) Prior Publication Data

US 2020/0331273 A1 Oct. 22, 2020

(51) Int. Cl.

| | |
|---|---|
| ***B41J 29/377*** | (2006.01) |
| ***B41J 23/02*** | (2006.01) |
| ***B41J 2/175*** | (2006.01) |

(52) U.S. Cl.

CPC ..... *B41J 2/175* (2013.01); *B41J 23/02* (2013.01); *B41J 29/377* (2013.01)

(58) Field of Classification Search

None

See application file for complete search history.

(56) References Cited

U.S. PATENT DOCUMENTS

| | | | | |
|---|---|---|---|---|
| 4,911,832 | A * | 3/1990 | Miller | E03D 9/00 134/169 R |
| 5,111,747 | A | 5/1992 | Kobler et al. | |
| 5,757,406 | A | 5/1998 | Kaplinsky et al. | |
| 6,341,853 | B1 * | 1/2002 | Scheffelin | B41J 2/17509 347/87 |
| 7,004,574 | B2 | 2/2006 | Neese et al. | |
| 7,556,365 | B2 * | 7/2009 | Stathem | B41J 2/17513 347/86 |
| 8,419,156 | B2 * | 4/2013 | Ito | B41J 29/393 347/16 |
| 8,857,810 | B2 | 10/2014 | Yoshii et al. | |
| 2008/0043076 | A1 | 2/2008 | Coffey et al. | |
| 2012/0200644 | A1 * | 8/2012 | Muto | B41J 2/17596 347/85 |
| 2013/0314477 | A1 | 11/2013 | Nozawa et al. | |
| 2014/0028768 | A1 | 1/2014 | Chen | |
| 2014/0347413 | A1 | 11/2014 | Ehara | |

FOREIGN PATENT DOCUMENTS

| | | |
|---|---|---|
| JP | 2006297661 | 11/2006 |

OTHER PUBLICATIONS

DTG Digital Viper 2 User Guide; Jan. 28, 2014; http://support.coldesi.eom/Portals/8/Viper2%20User%20Guide%201.02.pdf.

* cited by examiner

*Primary Examiner* — Alejandro Valencia
(74) *Attorney, Agent, or Firm* — HP Inc. Patent Department

(57) ABSTRACT

A rendering apparatus and a carriage for a rendering apparatus are provided, the carriage comprising a repository for a rendering fluid and an integrated mechanical pressure supply to pressurise the repository.

19 Claims, 9 Drawing Sheets

RENDERING FLUID DELIVERY

BACKGROUND

When print fluid is released from within a chamber inside a printhead, the internal pressure of the printhead internal print fluid repository chamber decreases. When the internal air pressure inside the printhead internal print fluid repository chamber is too low, the printhead undergoes a re-pressurisation before more print fluid can be released. In order for the air pressure to be transmitted to the printhead, the printhead is carried by a carriage which physically moves to a "servicing" side of the printer structure to enable a pump to re-pressurise the printhead. The pump can be remote from the printhead (independent) and may be fixed elsewhere in the printer structure from the printhead location. The air pressure is transmitted from an air supply to the printhead through a temporary closed circuit made of a tubing connection that is connected to the pump and air supply during "servicing".

The temporary connection of the tubing seals the printhead assembly. Air flow from the air supply into the printhead assembly increases the internal pressure. Once the internal pressure of the printhead is re-pressurised to a sufficient level the printhead is separated from the pump such that the tubing connection no longer supplies air pressure to the printhead. The printhead is then able to release print fluid or material for deposition onto a substrate, i.e. printing. The process can be repeated whenever the printhead is to be re-pressurised.

BRIEF DESCRIPTION OF THE DRAWINGS

Various features of certain examples will be apparent from the detailed description which follows, taken in conjunction with the accompanying drawings, which together illustrate, by way of example only, a number of features, wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

A rendering apparatus can use a rendering material such as a print fluid to render an article, which can be a 2D or 3D article for example. The rendering apparatus may be a print apparatus, for example a 2D or 3D printer, and the rendering material may be a print fluid or ink.

In an example, a rendering apparatus can use air pressure to drive a print fluid between different chambers inside a printhead and deposit the print fluid from one of the chambers onto a substrate. Each chamber can comprise a different coloured print fluid (for example C, M, Y, K). When the internal pressure of the printhead is sufficient, the printhead is able to release print fluid. Air pressure is provided using a sealed air chamber and a pump in fluid communication with the different chambers in the printhead. The printhead is carried by a carriage.

Figure 1A:
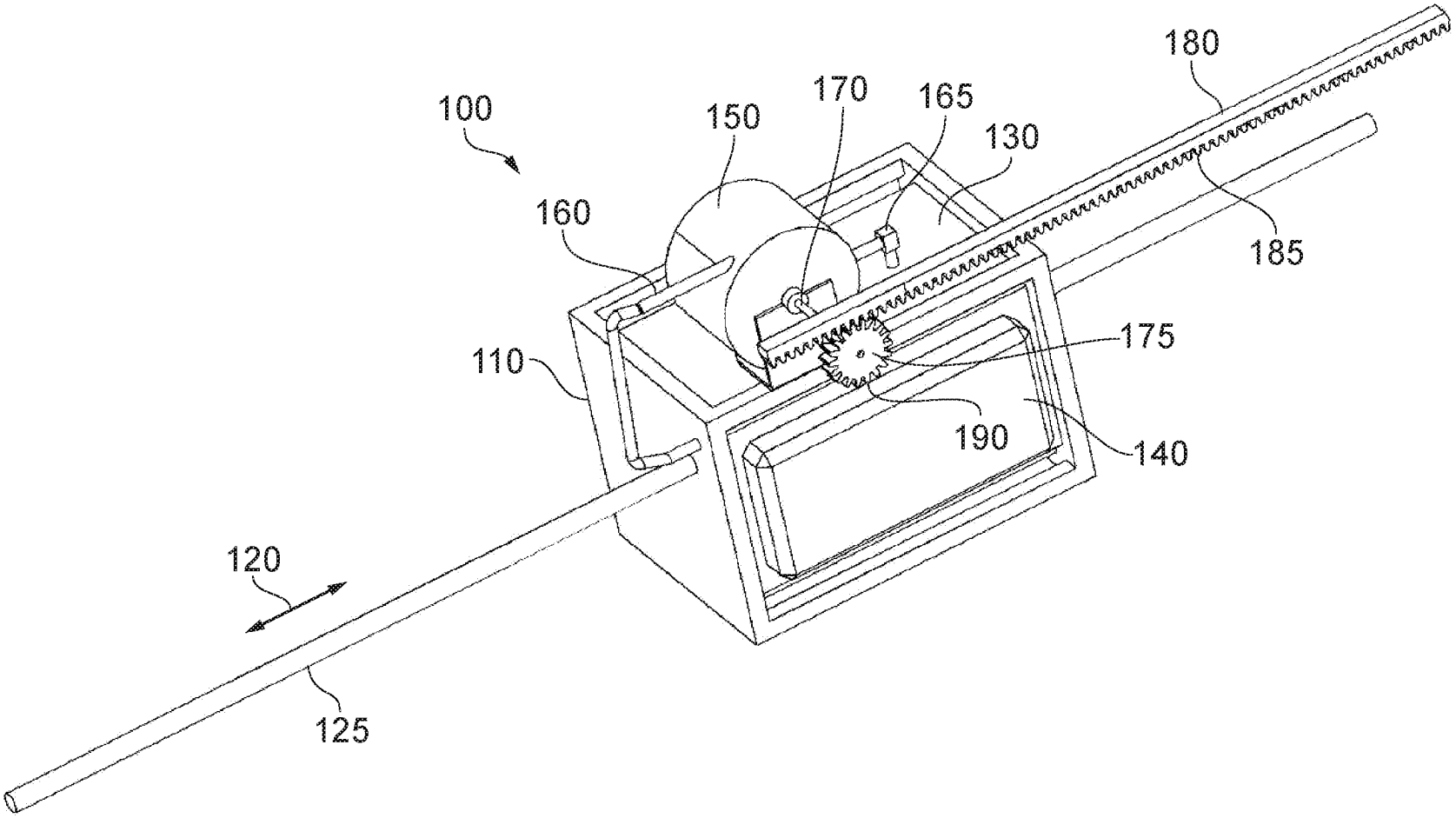
FIGS. 1A-D are schematics each showing a render apparatus according to an example.

FIG. 1A is a schematic representation of part of a carriage of a rendering apparatus according to an example. Carriage 110 can move along a print direction 120 along a print axis 125. The carriage print direction may be across a substrate onto which an image, for example, is rendered. The carriage comprises a printhead assembly 130 which includes a repository, print fluid management system, print nozzles 140, tubing connectors and valves. A rendering material or print fluid can be contained within the repository or cartridge, such as an ink cartridge, within the printhead assembly.

A sufficient air pressure inside the printhead enables deposition of the rendering material or print fluid from within chambers of the printhead onto a substrate. According to an example, as rendering fluid is released from the repository, the internal pressure of the printhead is maintained using an integrated mechanical pressure supply. The pressure supply enables ejection or release of the rendering fluid from within the repository during printing, for example continuously during continuous printing. The pressure supply may be connected to print nozzles 140 either directly or via the repository itself using connectors and valves. The rendering fluid can be released from within the repository via nozzles. Valves can be selectively activated in order to release the rendering fluid and hence deposit the rendering fluid onto a substrate.

In an example, a local pressure supply (pump) is provided in the carriage. The pressure supply may be an integrated mechanical pressure supply which may be integrated onto the carriage or the printhead assembly itself. The mechanical pressure supply comprises a pump 150. A low-pressure conduit or connection tube (per pigment or colour) 160 provides an inlet to the pump from a repository, i.e. a print fluid supply or ink supply cartridge. A high-pressure conduit or connection tube (per pigment or colour) 165 provides an outlet from the pump to the nozzles 140 in the printhead assembly. The conduits 160, 165 may contain print fluid.

The rendering apparatus may include a carriage path guide and a drive mechanism to cause movement of the carriage over a print medium. For example, the drive mechanism may cause simultaneous movement of the carriage, the repository, and the mechanical pressure supply repository along the carriage path guide to move print heads to particular locations over the medium to printed on. The drive mechanism may include any appropriate mechanical hardware to induce movement of the carriage. A drive mechanism may include mechanical hardware and a controller with instructions stored thereon to operate the mechanical hardware according to a movement control program. An example drive mechanism may include a gear-rack as described herein. In an example, a print fluid repository mount and a mechanical pressure supply mount may be interfaces included on a carriage to allow a repository and the mechanical pressure supply to be fixedly coupled to the carriage (e.g., to move with the carriage rather than independent thereof).

A driveshaft 170 connected to the pump and a gear 175 are arranged to operate the pump. The gear can engage with a gear-rack 180. The integrated mechanical pressure supply is connected to the carriage carrying the printhead. In an example the gear-rack 180 comprises a series of teeth 185.

The gear 175 can be circular and comprises teeth 190 on its circumference. The gear may be engaged to the gear-rack via corresponding teeth 185, 190.

Thus, according to an example, the pump can be powered using a rack and pinion arrangement, in which a linear motion of the carriage 110 along the print axis 125 is used to provoke a rotational motion of the gear 175 by way of its engagement with the rack 180, which is stationary with respect to the printhead assembly 130.

Figure 1B:
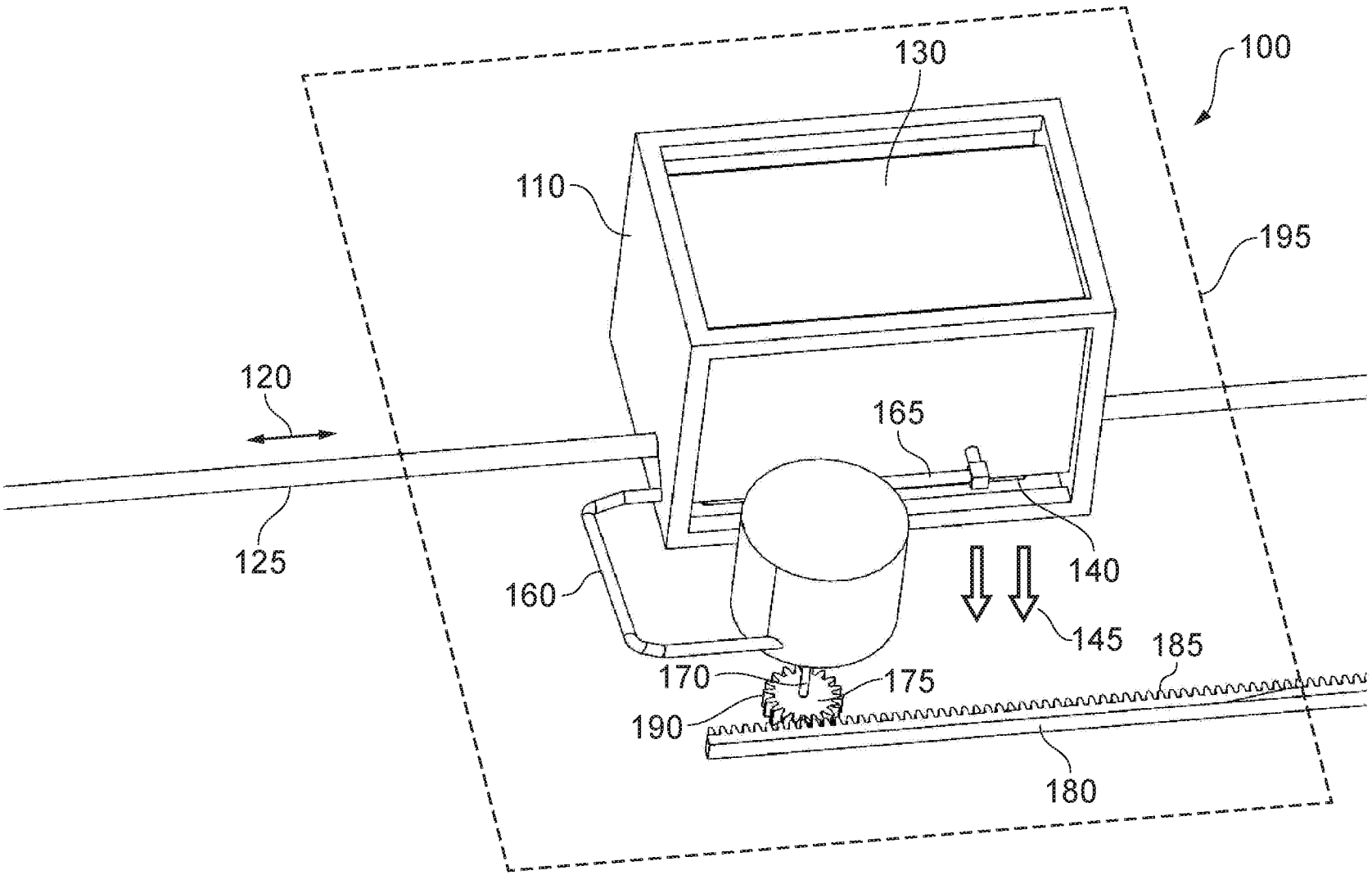

FIG. 1B is a schematic representation of part of a carriage of a rendering apparatus according to an example. In operation, as the carriage 110 is driven, for example electronically, it physically moves back and forth in the print direction 120 along a support 125. As the carriage physically moves, the gear 175 rotates via the interlocking teeth 185, 190 between the gear and gear-rack 180. The rotating gear is connected to the driveshaft 170. As the carriage physically moves, the rotation of the gear engaged to the gear-rack causes the driveshaft to rotate. The physical movement of the carriage therefore transfers kinetic energy to the pump 150. As the carriage moves, the pump is driven or operated. When the pump is driven it supplies pressure to a sealed air chamber (or pressure to the print fluid directly, depending on whether the arrangement of the print structure uses a driven print fluid pump or an air driven pump).

Print fluid is driven (pumped) from the repository inside the printhead assembly 130 under low pressure through the inlet conduit 160 to the pump. The print fluid is pumped through the pump to the nozzles 140 under a comparatively high pressure through the outlet conduit 165. The increased pressure inside the sealed air chamber is transmitted to the print fluid coming from inside the repository of the printhead assembly 130. Valves at the nozzles can be activated to selectively release print fluid 145.

Figure 1C:
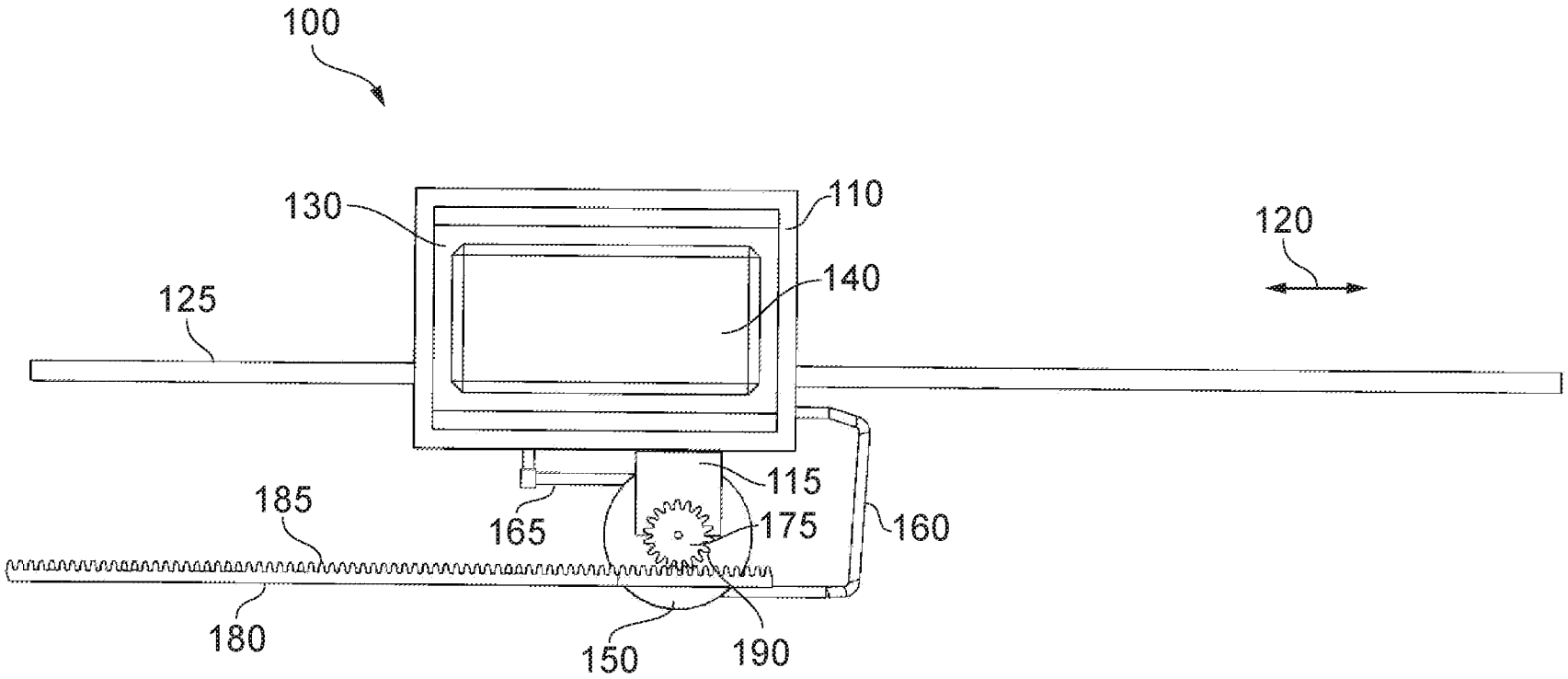
Figure 1D:
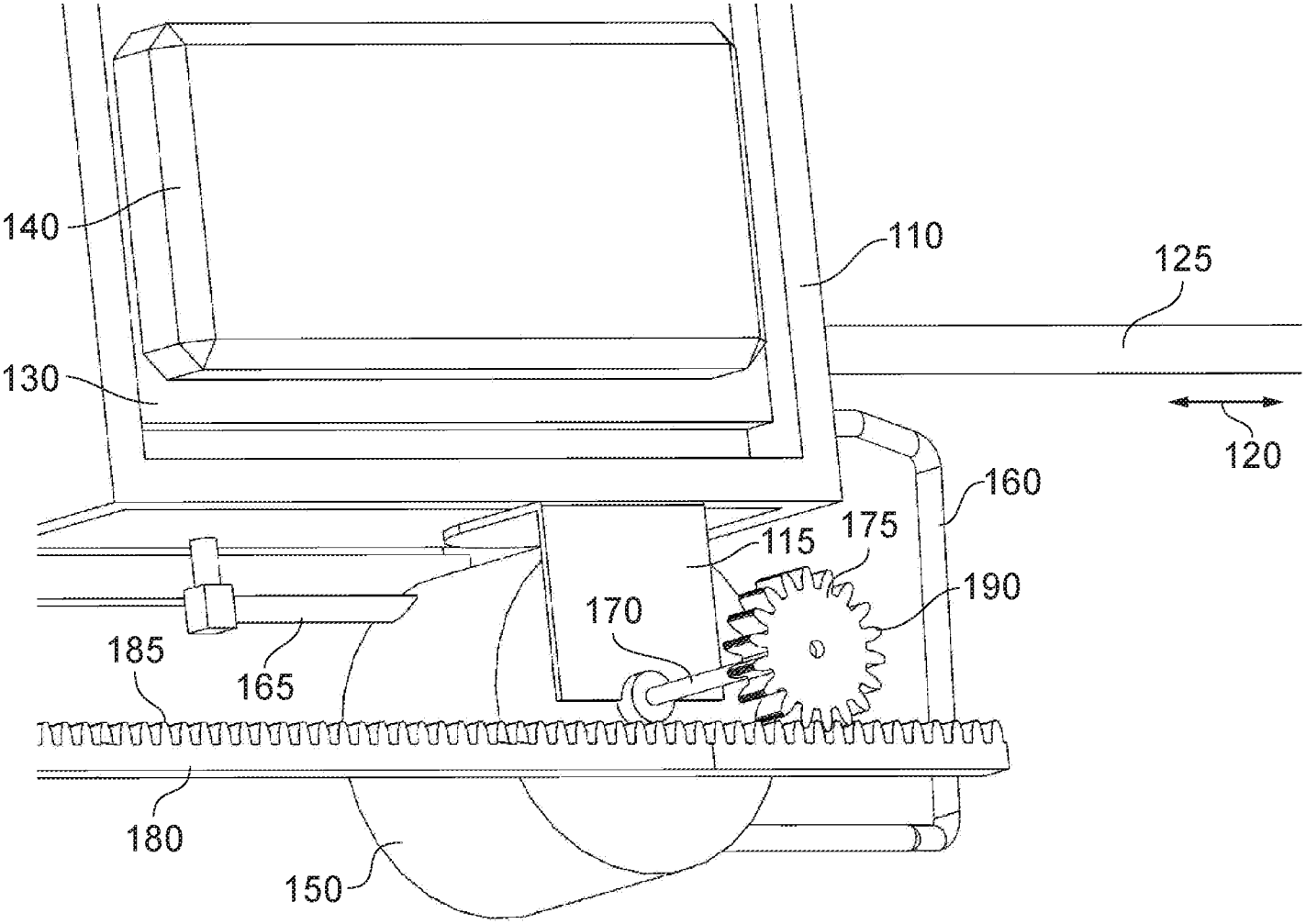

FIGS. 1C and 1D are schematic representations of part of a carriage of a rendering apparatus according to an example. In an example, the gear-rack 180 is arranged parallel to the print axis 125. The mechanical pressure supply is integrated with the carriage 110 via a mount 115. For example, the mount may be an L-shaped bracket to fix the pump, driveshaft and gear to the carriage.

According to an example, pump 150 does not use a power supply because, in operation, it uses the carriage movement to activate the pump and pressure supply, to generate energy to compress the local sealed air (or liquid) chamber and hence propel the print fluid through the printhead assembly to the nozzles. The gear-rack runs alongside the carriage such that the gear rotates along the gear-rack in operation. The rendering fluid is supplied to the print nozzles based upon a transformation of energy of the carriage movement through the integrated or embedded mechanical pressure supply (instead of being dependent upon a remote system communicated by tubing).

Figure 2A:
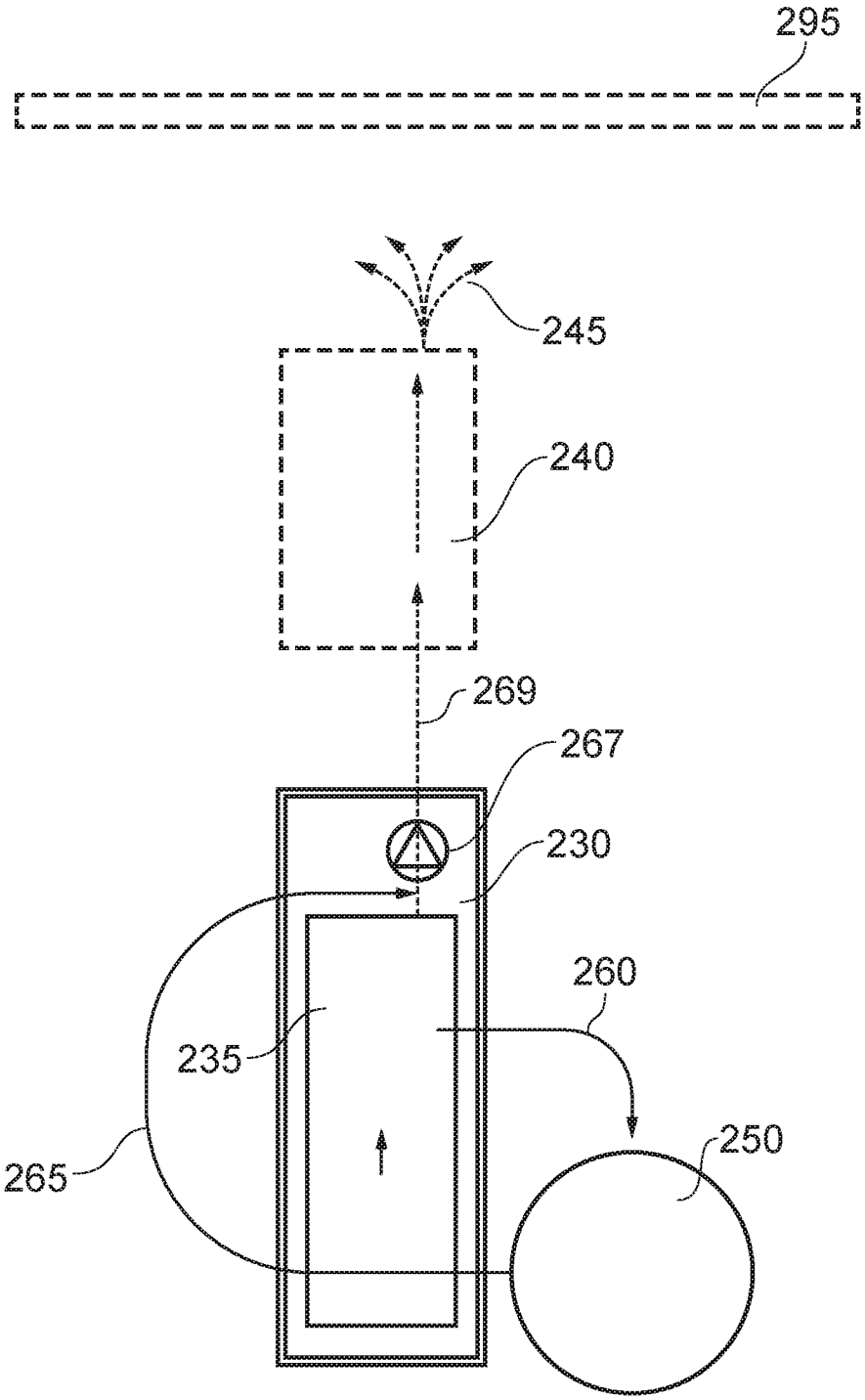
FIGS. 2A and 2B are schematics each showing internal parts of a render apparatus according to an example.

FIG. 2A is a schematic representation of part of a rendering apparatus according to an example. A printhead assembly 230 is shown with an integrated mechanical pressure supply. The printhead assembly may comprise a repository 235 for holding a rendering fluid therein. The integrated mechanical pressure supply comprises a pump 250. A low-pressure conduit 260 acts as an inlet to the pump from the repository. A high-pressure conduit 265 acts as an outlet from the pump to print nozzles 240. The conduits 260, 265 may contain rendering fluid for producing an image. In operation, the pump is mechanically driven by movement of a carriage which comprises the printhead assembly, as described with reference to FIGS. 1A-1D. Rendering fluid is drawn from the repository 235 through the conduits 260, 265 using pump 250 towards a valve 267. The increased pressure transmitted to the rendering fluid allows the rendering fluid to be driven through the valve when the valve is activated, for example electronically. The rendering fluid may flow or pass through a connecting conduit 269 towards the print nozzles 240. When the valve is activated the rendering fluid 245 is released from the print nozzles. The rendering fluid may be released onto a substrate 295, for example paper, to produce an image.

According to an example, there may be provided a plurality of repositories, each for holding a rendering fluid. The plurality of repositories may comprise a respective plurality of conduits or connecting tubes. For example, each repository may comprise a different pigment (C, M, Y, K).

Figure 2B:
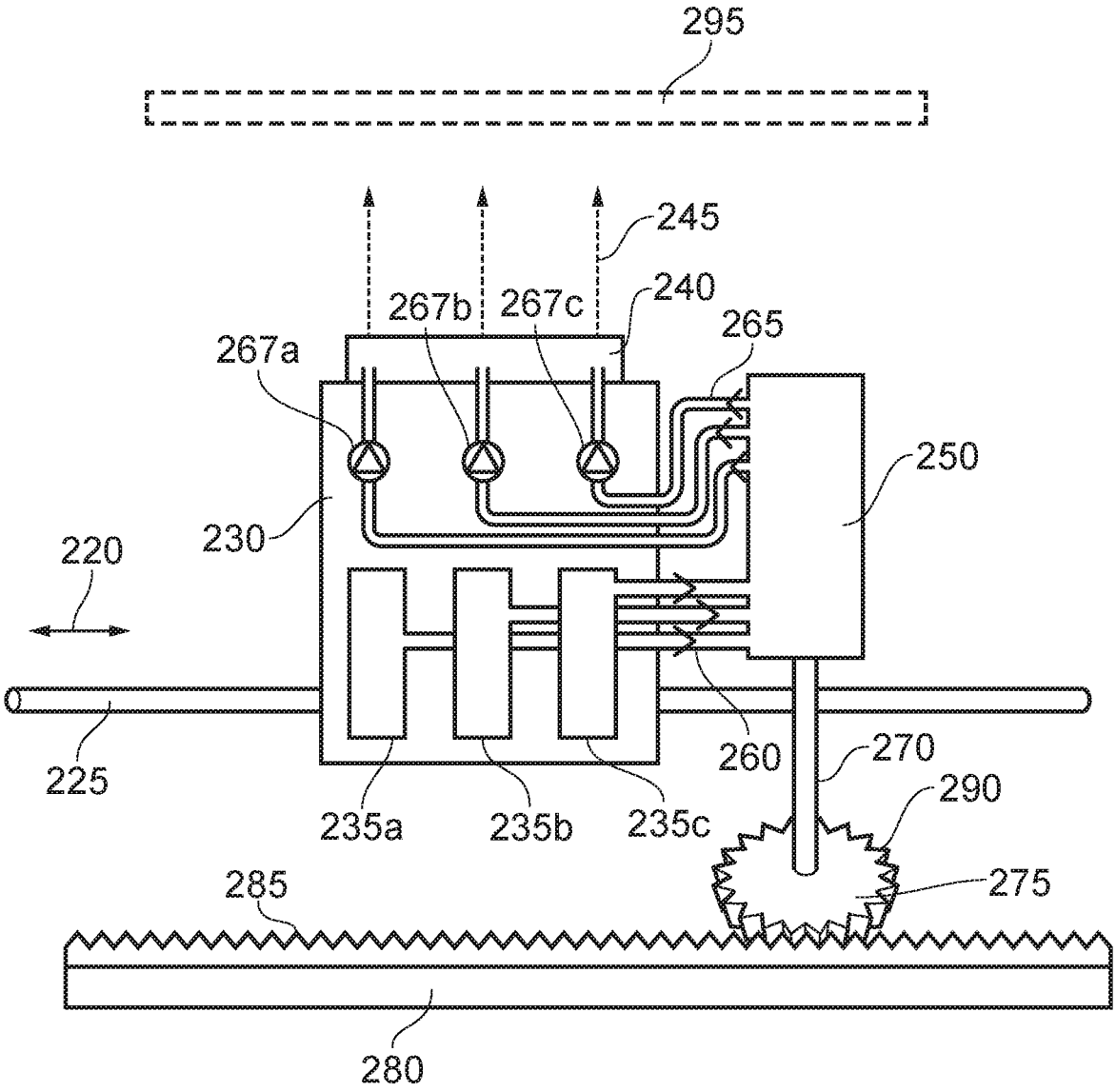

FIG. 2B is a schematic representation of part of a rendering apparatus according to an example. A printhead assembly 230 comprises multiple repositories 235*a-c* each of which can contain a rendering fluid. The printhead assembly may be mounted within a carriage that is arranged to translate or move along a print direction 220 along an axis 225. The rendering fluid contained within each of the repositories may comprise a different pigment or colour. For example, repository 235*a* may comprise a cyan pigment (C), repository 235*b* may comprise a magenta pigment (M) and repository 235*c* may comprise a yellow pigment (Y).

According to an example, low-pressure conduits 260 enable the flow of rendering fluid from within respective repositories to a mechanical pump 250. The pump is mechanically driven by a gear 275 and driveshaft 270 when the carriage to which the mechanical pressure supply is mounted is moved, as described above. The gear teeth 290 can be engaged with corresponding teeth 285 on a gear-rack 280.

Pump 250 causes rendering fluid within the conduit 260 to flow through the pump and into a high-pressure conduit 265 at the pump outlet. The conduit 265 transports the rendering fluid to print nozzles 240 via a system of connecting conduits and valves 267*a-c*. A valve may be provided for each repository or number of rendering fluid pigments. The valves 267*a-c* may be activated to selectively control release of the rendering fluid 245 from each of the print nozzles. The rendering fluid may be deposited onto a substrate 295 to produce an image.

According to an example, movement of the carriage may additionally or alternatively be translated to power a blower (not shown) that can be used to supply air to the repository or commercial replaceable print fluid supply (as will be described below with reference to FIG. 4).

According to an example, the pressure supply or air supply of some rendering apparatuses may comprise an atmospheric air inlet. Such examples may relate to small apparatuses having rendering fluid bags or ink bags that are sealed. Rendering fluid or ink is suctioned from the bags by a pump and the rendering fluid or ink is forced to flow continuously through a closed circuit (albeit with valves selectively controlling release of the print fluid).

Figure 3A:
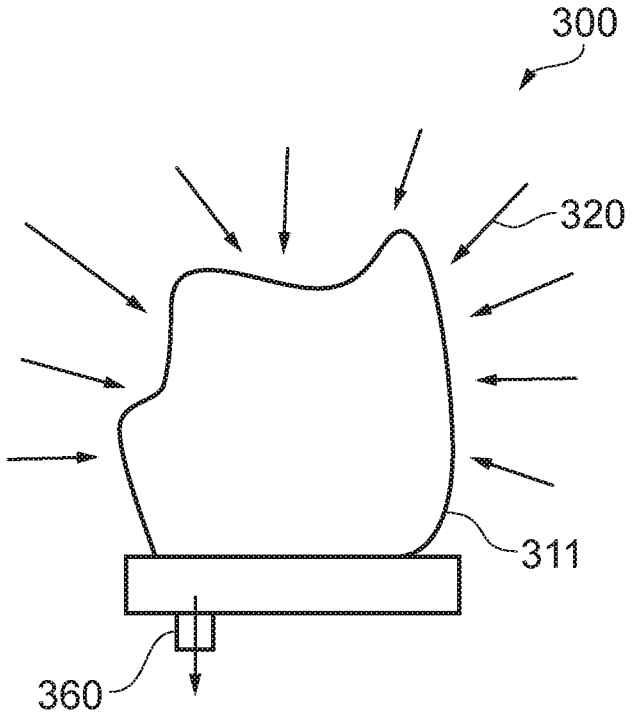
FIGS. 3A and 3B are schematics each showing a rendering fluid bag according to an example.

According to an example, each repository may comprise a rendering fluid bag. FIG. 3A shows a repository 300 according to an example. The rendering fluid bag 311 may comprise a flexible, plastics wrap. The bag may comprise a rendering fluid. The bag may be surrounded by atmospheric pressure 320 which exerts a force on the outer side of the bag. A conduit 360 is connected to the bag to provide a low-pressure connection to allow flow of rendering fluid from within the bag to a mechanical pump (not shown). As rendering fluid is drawn from the bag by the pump, the flexible bag is compressed by the surrounding atmospheric pressure. In an example, the rendering fluid bag may comprise a single use, disposable cartridge.

Figure 3B:
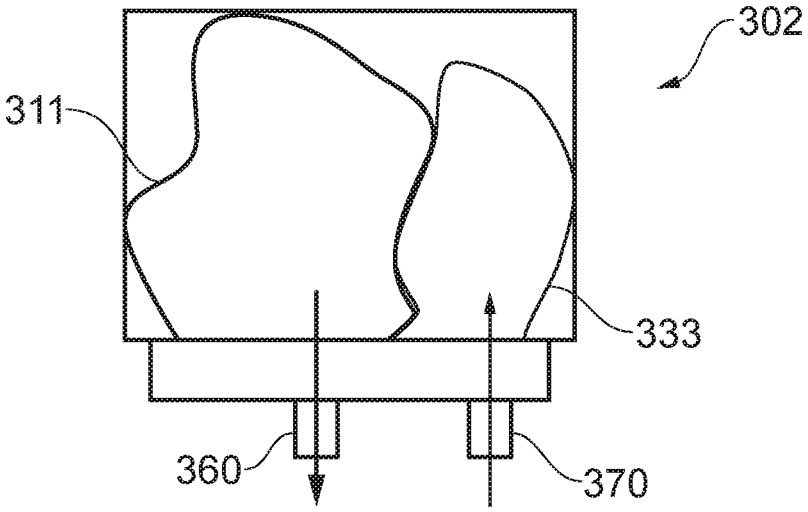

According to an example, each repository may comprise a rendering fluid bag and an air bag. FIG. 3B shows a repository 302 according to an example. The rendering fluid bag 311 may comprise a flexible, plastics wrap. The bag may comprise a rendering or print fluid. Adjacent the bag can be provided an air bag 333 which exerts a force on the rendering fluid bag to compress the bag and rendering fluid held within. A conduit 360 connected to the rendering fluid bag allows rendering fluid to flow under low pressure to a mechanical pump. A conduit 370 connected to the air bag allows a flow or supply of air into the air bag. As air is supplied into the air bag, which may comprise a flexible, plastics material, the air bag expands to exert a pressure onto the rendering fluid bag. The rendering fluid bag is compressed and rendering fluid caused to flow from the rendering fluid bag. Air may be supplied to the air bag from an air source that is integral with the carriage and pump.

The rendering fluid delivery apparatus and system described herein comprise a local pressure supply (i.e. pump) embedded in the moveable carriage to provide a compact printing or imaging structure. The local pressure supply pumps rendering fluid between different chambers inside the printhead using pressure. For example, pressure is supplied via the pump, driveshaft and gear as the carriage is electronically powered to translate in the printing direction. The pump is mechanically powered and is provided as part of the carriage, hence the pump moves in unison with the carriage.

According to an example, a printer structure serving a medium to high print fluid consumption platform (compared to a low print fluid consumption) may require additional pressure to push print fluid around the printhead.

Figure 4:
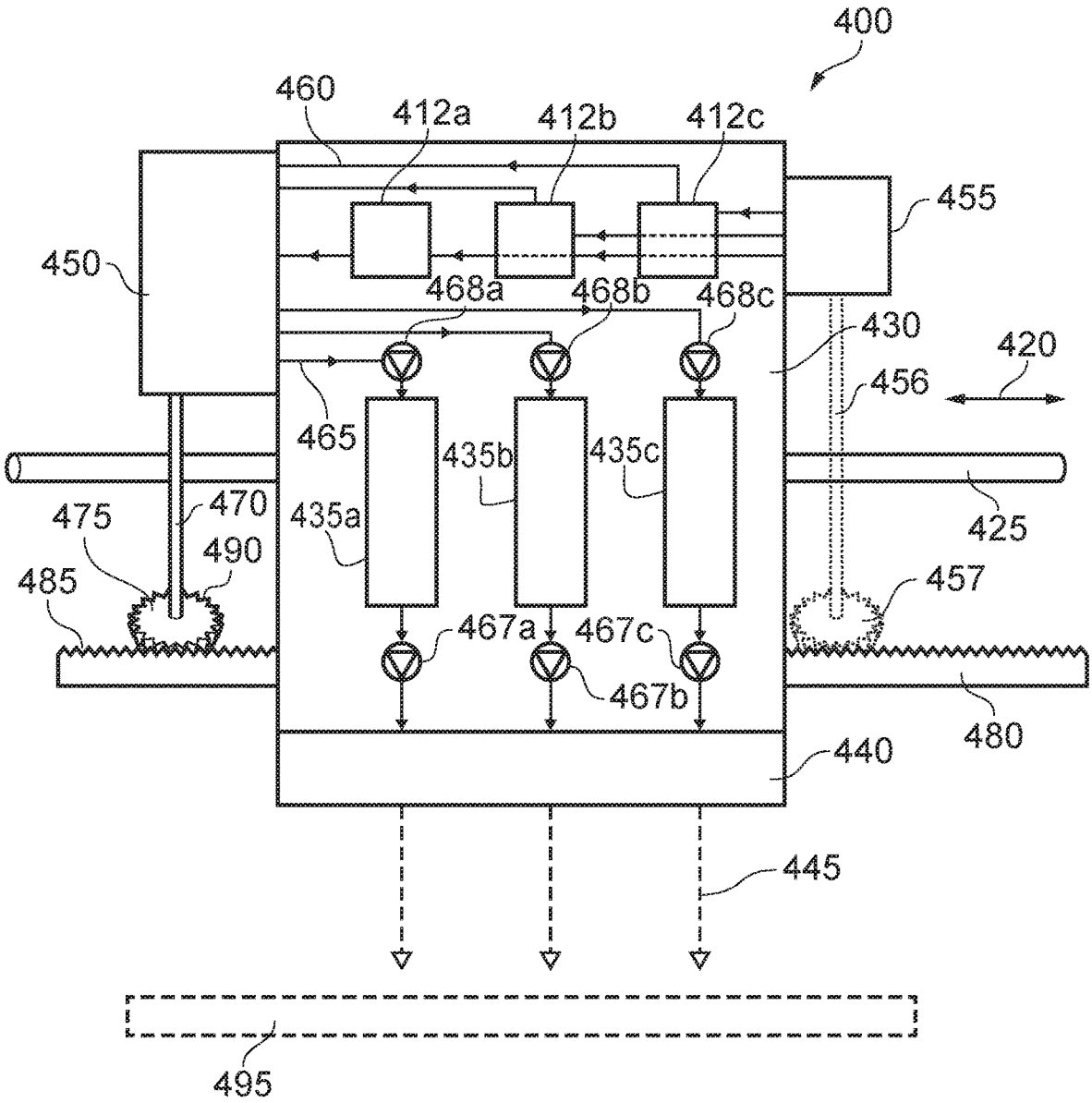
FIG. 4 is a schematic showing internal parts of a render apparatus according to an example.

FIG. 4 is a schematic representation of part of a rendering apparatus 400 according to an example. As shown, a printhead assembly 430 comprises a plurality of repositories 435*a-c* each containing a rendering fluid which comprise different pigments. Each repository is supplied with rendering fluid via a rendering fluid bag 412*a-c*. The printhead assembly is integrally mounted or embedded to a carriage that is able to translate or move along a print axis 425 and print direction 420. As the carriage is translated a gear 475 rotates along a gear-rack 480, teeth 485, 490 engage to transfer energy via a driveshaft 470 and power a pump 450. When the carriage is moving and the pump is in operation, the rendering fluid within the rendering fluid bags 412*a-c* is drawn through connecting tubes 460 to the pump. The rendering fluid delivery system 400 comprises a plurality of low-pressure conduits 460 that allow flow of rendering fluid from within a respective plurality of rendering fluid bags to a mechanical pump 250. The pump causes rendering fluid within the conduit 460 to flow through the pump and into a high-pressure conduit 465 at the pump outlet. The rendering fluid is transported through the pump 450 to outlet connecting tubes 465. The conduit 465 transports the rendering fluid to print nozzles 440 via a system of connecting conduits and valves 467*a-c*. A set of valves 468*a-c* may be provided to selectively allow rendering fluid to pass to repositories 435*a-c*. Each repository may comprise a corresponding valve. The rendering fluid is pressurised to flow through the repositories and to print nozzles 440 that comprise valves 467*a-c* to selectively operate each print nozzle. Rendering fluid that is released 445 may be deposited on a substrate 495 to produce an image.

According to an example, movement of the carriage is translated to power a blower 455 that is used to supply air to a repository. In an example, the blower may be integral with the pump and the driveshaft extended to serve both the blower and the pump simultaneously (not shown). An air supply may be locally integrated with the blower and the carriage. Additionally, or alternatively, a connecting tube (not shown) may supply air to the blower from a location elsewhere in the printer structure. The blower 455 may be electronically powered or may comprise a mechanical drive system. The blower may be driven by a gear 457 engaged to a gear-rack 480. The blower 455 may be integrated with a carriage such that when the carriage moves the mechanical drive system is operated. When the carriage moves the gear 457 rotates along the gear-rack 480 to transfer energy via a driveshaft 456 to the blower 455. When in operation the blower supplies air pressure to the rendering fluid bags to replenish pressure in the rendering fluid as the nozzle valves are opened to release rendering fluid and therefore cause a decrease in pressure.

According to an example, there is provided a number of different pigments in each repository and rendering fluid bag to equal the number of connecting inlet tubes 460 and equal the number of outlet tubes 465. For example, in a printer structure having four different pigments (C, M, Y, K) there is provided four inlet tubes 460 and four outlet tubes 465. There may be provided the same number of set of nozzles as are provided different pigments. For example, four sets of nozzles may be provided, each serving a different pigment (C, M, Y, K).

Figure 5:
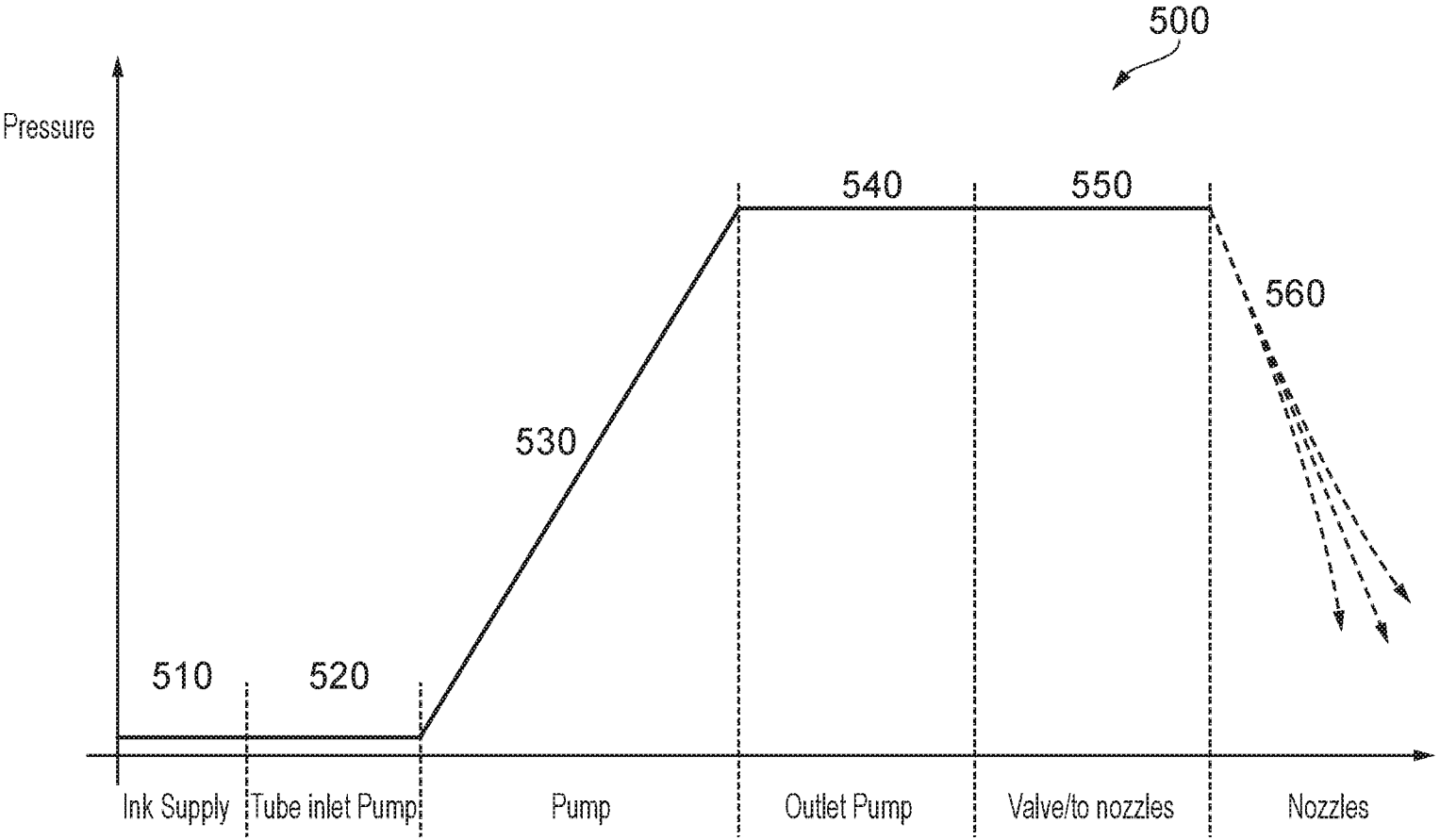
FIG. 5 is a schematic showing the internal pressure level in a printhead per operation stage according to an example.

FIG. 5 is a schematic showing the internal pressure level 500 in a printhead per operation stage. At stage 510 rendering fluid is supplied, for example from a rendering fluid bag (412*a-c*) at low pressure. At stage 520 the rendering fluid is supplied via an inlet tube (460) at low pressure to a pump (450). At stage 530 the pump is operated to increase the pressure level of the rendering fluid for transportation through the printhead. At stage 540 the pressurised rendering fluid flows through an outlet (465) from the pump. At stage 550 the pressurised rendering fluid flows via valves (467*a-c*) to print nozzles (440). At stage 560 the rendering fluid is selectively released by the set of print nozzles to reduce the internal pressure of the printhead.

As described herein, a mechanic pressure generator, i.e. a pump or blower, is provided which uses mechanic impulsion (instead of electricity) for a rendering fluid delivery system. According to an example, the delivery system comprises:

1) a blower (element with external air intake and connection fittings), and 2) a gear/pulley that transmits movement from the carriage at the time of printing or image rendering through, for example, 3) an internal driveshaft, and 4) an external rack that operates with the gear to form a gear-rack, where 5) air may be stored at a higher pressure in a common chamber within the printhead.

During a start-up condition or initial operation procedure, air pressure may be supplied to vent chambers within the printhead, open internal valves within the printhead, and impulse rendering fluid. A blower and/or pump may be integrally located with a carriage and operated in line with the carriage operation or movement. In operation, air pressure is supplied through connecting tubes and/or valves. The pump and/or blower pressure generation occurs through the carriage movement by engaging a gear in an external rack (gear-rack). The pressure generated may be transmitted through fixed tubing (such that there is no risk of intermediate sealing connections) to a common air chamber, and is then used to vent repository or cartridge chambers or impulse rendering fluid or ink from an internal rendering fluid bag or ink chamber to printhead nozzles.

The delivery system embedded in the same integrated element, i.e. the printhead assembly or carriage, provides more reliability of functions, for example. The rendering fluid delivery apparatus and system described herein reduces the risks associated with leaking connections due to the provision of the pressure supply integrated with the carriage. There is no requirement for remote tubing connections with connectors, valves and pipelines, thus avoiding issues associated with air leakage which are otherwise difficult to detect, spot and fix. For example, it removes a temporal connection with a remote air supply which can otherwise introduce dust that can block conduits or connections. This allows for an ease in service replacement operations based on centring all elements onto the carriage. Less troubleshooting may be needed for service operations or engineer repairs saving costs, for example.

The integrated approach of providing a local pressure supply or pump embedded in the printhead or carriage allows for a printer structure having less parts. By integrating all the supplies (power, signal and pressure) in the printhead assembly, less parts are required since a tube connection is not required between a remote pump and the printhead or carriage, for example. For example, by centring the control of pressure in the carriage control, this removes the need for electronics, wiring and electronic controls, i.e. it saves on tubing, valves, connectors, electronic boards, wiring, power wiring and electronic controls. There is no requirement for a separate, electrically powered air pump at the side of the printing structure that engages with a print fluid cartridge during "service" modes to pressurise the print fluid repository, for example.

The integrated approach of providing a local pressure supply or pump embedded in the printhead or carriage allows for a faster rendering process. Air pressure is supplied continuously each time the carriage or printhead physically moves. This maintains a sufficient internal pressure in the printhead for releasing print fluid, i.e. since the pressure supply depends on the carriage movement, there is no requirement to stop printing for the carriage to go to "servicing" (connecting both sides of the circuit, closing it, and allowing the pressure generated in the remote pump to be transferred to the printhead), for example. Instead, the air pressure is dynamically maintained in the printhead a until the carriage goes to print again and the remaining pressure inside the printhead chambers wastes through the print fluid use, venting and unavoidable.

While the apparatus, system and related aspects have been described with reference to certain examples, various modifications, changes, omissions, and substitutions can be made without departing from the spirit of the present disclosure. In particular, a feature or block from one example may be combined with or substituted by a feature/block of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A rendering apparatus comprising a carriage;

a repository for a rendering fluid mounted on the carriage;

an integrated mechanical pressure supply to pressurise the repository, the integrated mechanical pressure supply also mounted on the carriage to generate pressure to pressurize the repository on the carriage; and a gear-rack arranged along a path of the carriage, a gear engaged with the gear-rack being connected to the integrated mechanical pressure supply to supply energy to the integrated mechanical pressure from movement of the carriage.

2. The apparatus of claim 1, wherein the mechanical pressure supply comprises a pump.

3. The apparatus of claim 2, wherein the mechanical pressure supply comprises a driveshaft and a gear connected to the pump.

4. The apparatus of claim 2, wherein the pump comprises at least one inlet conduit supplying the rendering fluid to the pump.

5. The apparatus of claim 2, wherein the pump comprises at least one outlet conduit connecting the pump to the repository.

6. The apparatus of claim 1, further comprising a rendering fluid bag in the repository.

7. The apparatus of claim 6, further comprising an integrated mechanical blower mounted on the carriage to supply air pressure to the rendering fluid bag.

8. The apparatus of claim 7, wherein the mechanical blower comprises a driveshaft and a gear.

9. A rendering apparatus comprising:

a carriage, a repository for a rendering fluid coupled to the carriage;

a mechanical pressure supply coupled to the carriage, the mechanical pressure supply to pressurise the repository;

a carriage path guide;

a drive mechanism to cause simultaneous movement of the carriage, the repository, and the mechanical pressure supply along the carriage path guide; and a gear-rack arranged along the carriage path guide, a gear engaged with the gear-rack being connected to the mechanical pressure supply to supply energy to the mechanical pressure from movement of the carriage.

10. A rendering apparatus as claimed in claim 9, further comprising a gear-rack.

11. A rendering apparatus as claimed in claim 9, wherein the mechanical pressure supply comprises a pump.

12. A rendering apparatus as claimed in claim 11, wherein the mechanical pressure supply comprises a driveshaft and a gear connected to the pump.

13. A rendering apparatus as claimed in claim 9, further comprising an integrated mechanical blower to supply air pressure to a rendering fluid bag.

14. A rendering apparatus as claimed in claim 13, wherein the mechanical blower comprises a driveshaft and a gear.

15. A rendering apparatus comprising a carriage;

a repository for a rendering fluid mounted on the carriage; and an integrated mechanical pressure supply to pressurise the repository, the integrated mechanical pressure supply also mounted on the carriage to generate pressure to pressurize the repository on the carriage;

wherein the mechanical pressure supply comprises a pump; and wherein the mechanical pressure supply comprises a driveshaft and a gear connected to the pump;

the apparatus further comprising a gear-rack arranged along a path of the carriage, the gear engaged with the gear-rack to supply energy to the pump from movement of the carriage relative to the gear-rack.

16. The apparatus of claim 15, further comprising a blower mounted on the carriage, the blower also has a gear engaged with the gear-rack to supply energy to the blower from movement of the carriage relative to the gear-rack.

17. The apparatus of claim 1, wherein the repository comprises:

a bag for containing the rendering fluid; and a pressure bag expandable with pressure from the mechanical pressure supply to apply pressure to the bag for containing the rendering fluid.

18. The apparatus of claim 1, wherein:

the repository comprises a plurality of compartments for containing different rendering fluids; and each compartment of the repository is connected through a valve to a print head that comprises nozzles for deposition of the rendering fluids.

19. The apparatus of claim 18, wherein each of the compartments in the repository comprises a different color of ink as the rendering fluid.

* * * * *